US011692245B2

(12) United States Patent
Vargas et al.

(10) Patent No.: US 11,692,245 B2
(45) Date of Patent: Jul. 4, 2023

(54) NICKEL ALLOY COMPOSITION WITH BORON AND NITROGEN

(71) Applicant: RAYTHEON TECHNOLOGIES CORPORATION, Farmington, CT (US)

(72) Inventors: Chris Vargas, West Hartford, CT (US); Carl Busta, Glastonbury, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 17/694,780

(22) Filed: Mar. 15, 2022

(65) Prior Publication Data

US 2022/0298605 A1 Sep. 22, 2022

Related U.S. Application Data

(60) Provisional application No. 63/163,319, filed on Mar. 19, 2021.

(51) Int. Cl.
*C22C 19/05* (2006.01)

(52) U.S. Cl.
CPC ..... *C22C 19/055* (2013.01)

(58) Field of Classification Search
CPC ..... C22C 19/055; C22F 1/10
See application file for complete search history.

(56) References Cited

U.S. PATENT DOCUMENTS

| | | | |
|---|---|---|---|
| 2017/0335705 | A1 | 11/2017 | Tyler et al. |
| 2018/0044766 | A1 | 2/2018 | Tidesten |
| 2018/0369919 | A1 | 12/2018 | Burkhardt |

FOREIGN PATENT DOCUMENTS

| | | |
|---|---|---|
| CN | 1315585 | 10/2001 |
| DE | 102016208761 | 11/2017 |

OTHER PUBLICATIONS

European Search Report for European Patent Application No. 22161317.7 dated Aug. 24, 2022.

*Primary Examiner* — Jessee R Roe
(74) *Attorney, Agent, or Firm* — Carlson, Gaskey & Olds, P.C.

(57) ABSTRACT

An alloy composition includes, by weight: 20% to 23% of Cr; 8% to 10% of Mo; 3.15% to 4.15% of Nb+Ta; 0.25% to 1.5% of B; 0.35% to 1.75% of N; and a balance of Ni.

16 Claims, 3 Drawing Sheets

NICKEL ALLOY COMPOSITION WITH BORON AND NITROGEN

CROSS-REFERENCE TO RELATED APPLICATIONS

The present disclosure claims priority to U.S. Provisional Application No. 63/163,319 filed Mar. 19, 2021.

BACKGROUND

Nickel alloys are known and used for components that are subjected to relatively high operating temperatures. One process for fabricating such components is metal injection molding (MIM). In comparison to casting, for example, MIM is often considered to be a high volume process that is suited for relatively small component shapes. MIM involves mixing an alloy powder with a binder. The mixture is then heated and injected into a die cavity to form a green component. The green component is then heat treated to remove the binder and thereby form a brown component. The brown component is then sintered to consolidate the alloy powder.

SUMMARY

An alloy composition according to an example of the present disclosure includes, by weight, 20% to 23% of Cr, 8% to 10% of Mo, 3.15% to 4.15% of Nb+Ta, 0.25% to 1.5% of B, 0.35% to 1.75% of N, and a balance of Ni.

In a further embodiment of any of the foregoing embodiments, the B is 0.5% to 1.2%.

In a further embodiment of any of the foregoing embodiments, the N is 0.7% to 1.6%.

In a further embodiment of any of the foregoing embodiments, the B is 0.5% to 1.2% and the N is 0.7% to 1.6%.

In a further embodiment of any of the foregoing embodiments, the B is 0.4% to 0.7%.

In a further embodiment of any of the foregoing embodiments, the N is 0.6% to 0.9%.

In a further embodiment of any of the foregoing embodiments, the B is 1.1% to 1.3%.

In a further embodiment of any of the foregoing embodiments, the N is 1.4% to 1.7%.

An article according to an example of the present disclosure includes an alloy of the following composition, by weight, 20% to 23% of Cr, 8% to 10% of Mo, 3.15% to 4.15% of Nb+Ta, 0.25% to 1.5% of B, 0.35% to 1.75% of N, and a balance of Ni.

In a further embodiment of any of the foregoing embodiments, the alloy has a microstructure that includes an acicular phase and a non-acicular phase.

In a further embodiment of any of the foregoing embodiments, the acicular phase is Nb-rich.

In a further embodiment of any of the foregoing embodiments, the acicular phase includes, by weight, at least 25% Nb.

In a further embodiment of any of the foregoing embodiments, the non-acicular phase is Mo-rich.

In a further embodiment of any of the foregoing embodiments, the non-acicular phase incudes, by weight, at least 50% Mo.

In a further embodiment of any of the foregoing embodiments, the acicular phase is Nb-rich and includes, by weight, at least 25% Nb, the non-acicular phase is Mo-rich and incudes, by weight, at least 50% Mo, and microstructure has, by volume, 6% to 10% of the non-acicular phase and 0.5-4% of the acicular phase.

In a further embodiment of any of the foregoing embodiments, the B is 0.5% to 1.2%.

In a further embodiment of any of the foregoing embodiments, the N is 0.7% to 1.6%.

A method of fabricating an article according to an example of the present disclosure includes providing a mixture of a binder, an alloy powder, and a boron nitride powder. The alloy powder and the boron nitride powder have the following combined composition, by weight, 20% to 23% of Cr, 8% to 10% of Mo, 3.15% to 4.15% of Nb+Ta, 0.25% to 1.5% of B, 0.35% to 1.75% of N, and a balance of Ni. The mixture is injected into a mold to form a green article, and the binder then removed from the green article to form a brown article. The brown article is sintered to consolidate the alloy powder and thereby form a consolidated article.

In a further embodiment of any of the foregoing embodiments, the consolidated article has a microstructure that includes an acicular phase and a non-acicular phase. The acicular phase is Nb-rich, and the non-acicular phase is Mo-rich.

In a further embodiment of any of the foregoing embodiments, the B is 0.5% to 1.2% and the N is 0.7% to 1.6%.

The present disclosure may include any one or more of the individual features disclosed above and/or below alone or in any combination thereof.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
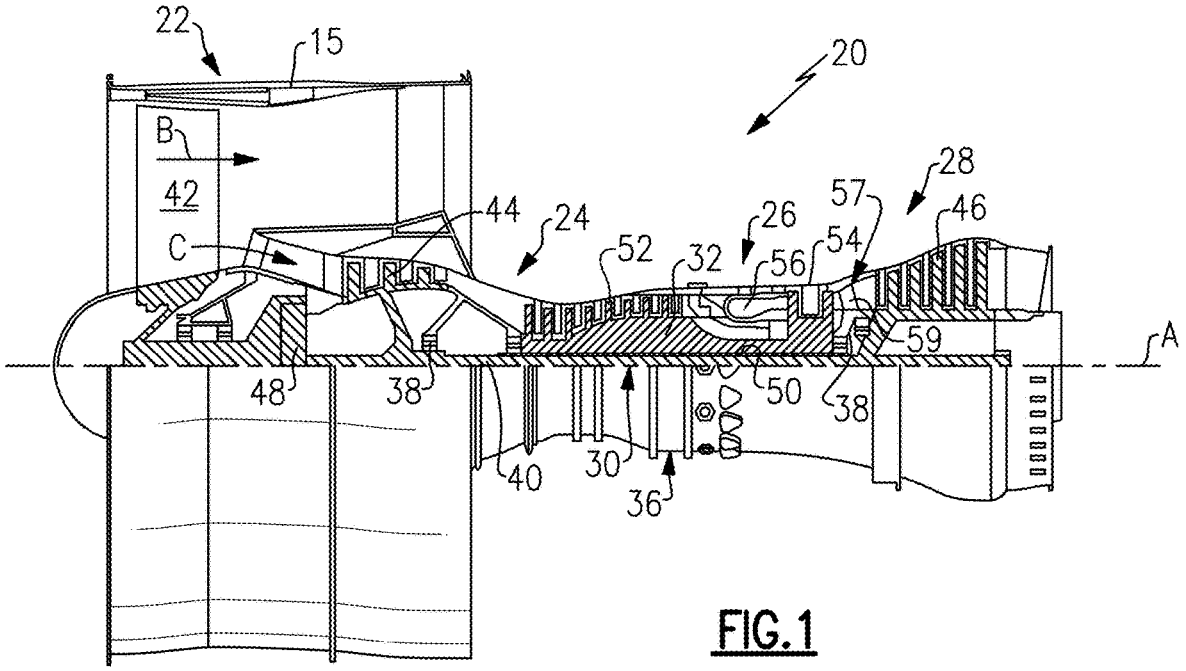
FIG. 1 illustrates a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a housing 15 such as a fan case or nacelle, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded through the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Various articles in the engine 20 may be formed of Ni alloys. At least some of those articles, such as but not limited to bearings and bushings, are subject to wear during engine operation. While Ni alloys exhibit good toughness and high temperature strength, they are not generally considered to have good wear/friction performance. In this regard, disclosed herein is a Ni alloy composition for facilitating enhanced wear/friction performance in gas turbine engine articles, such as bearings and bushings.

The Ni alloy composition incorporates boron and nitrogen to obtain a hard, self-lubricating alloy. For instance, the boron and nitrogen are incorporated into the composition during metal injection molding fabrication of the article. As will described in further detail below, boron nitride is mixed with Ni alloy powder for the injection molding. Upon sintering, the boron nitrogen disassociates and forms distinct microstructural phases in the end article.

The alloy has a composition, by weight, of: 20% to 23% of Cr; 8% to 10% of Mo; 3.15% to 4.15% of Nb+Ta; 0.25% to 1.5% of B; 0.35% to 1.75% of N; and a balance of Ni (and any impurities). In a further example, the B is 0.5% to 1.2% and the N is 0.7% to 1.6%. In one example toward the lower ends of the above ranges, the B is 0.4% to 0.7% and the N is 0.6% to 0.9%. In one example toward the upper ends of the above ranges, the B is 1.1% to 1.3% and the N is 1.4% to 1.7%.

Figure 2:
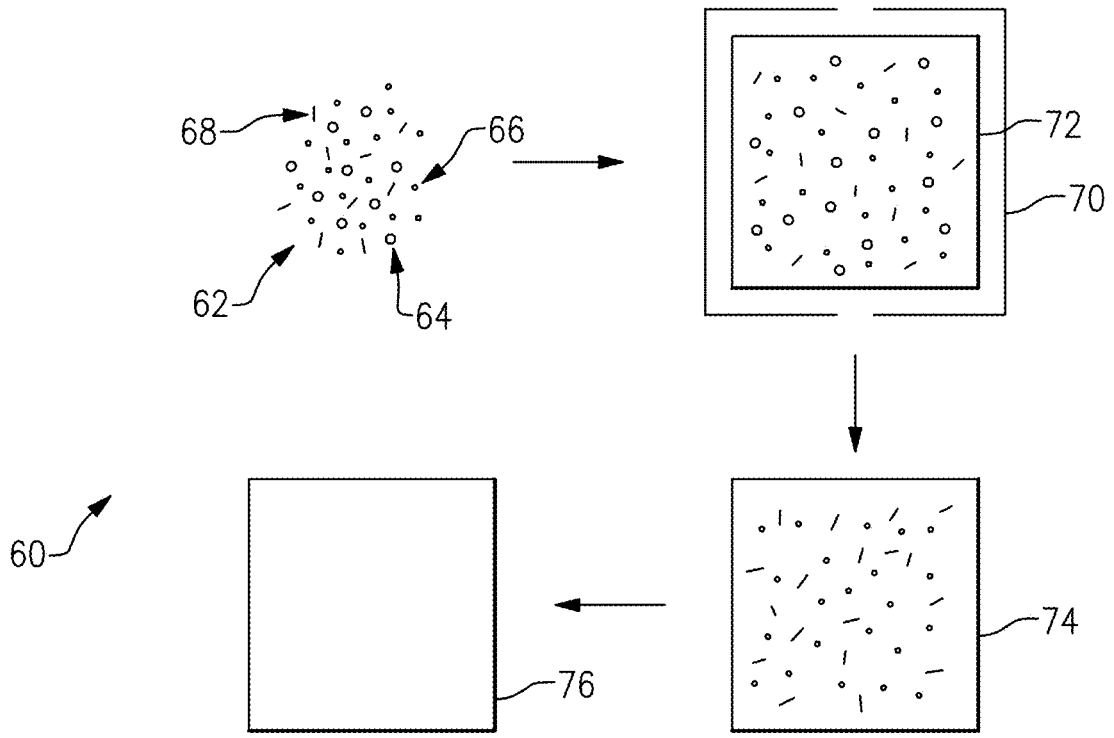
FIG. 2 illustrates a method of fabrication by metal injection molding.

FIG. 2 illustrates an example method 60 of fabricating an article by metal injection molding. The method 60 includes providing an initial mixture 62 of a binder 64, an alloy powder 66, and a boron nitride powder 68. For example, the binder 64 is a polymer, such as but not limited to polyethylene, polypropylene, or wax and is provided in an amount sufficient to carry the alloy powder 66 during molding and bind the alloy powder 66 in the "green" molded shape. For instance, the initial mixture 62 has, by volume, 30% to 50% of the binder 64, but it is to be understood that the amount can be varied for the particular implementation conditions. The combined composition of the alloy powder and the boron nitride is as described above. For instance, the starting alloy powder is of the desired final composition, but without the boron and nitrogen. In general, the combined composition can be achieved by mixing the starting alloy powder and the boron nitride in a ratio, by volume, of 95:5 to 90:10.

The mixture 62 is then injected into a mold 70 to form a green article 72. For example, the mixture 62 is heated to the melting point of the binder 64 so that the mixture can flow under pressure. After injection, the binder 64 is then removed from the green article 72 to form a brown article 74. For instance, the green article 72 is heated at a temperature at which the binder 64 volatilizes. The brown article 74 is then sintered to consolidate the alloy powder and thereby form a consolidated article 76. In one example, binder removal is conducted at approximately 600° C. in an argon atmosphere and sintering is conducted at 1200° C. under vacuum. Given this disclosure, one of ordinary skill in the art will recognize appropriate injection conditions, binder removal conditions, and sintering conditions.

Figure 3:
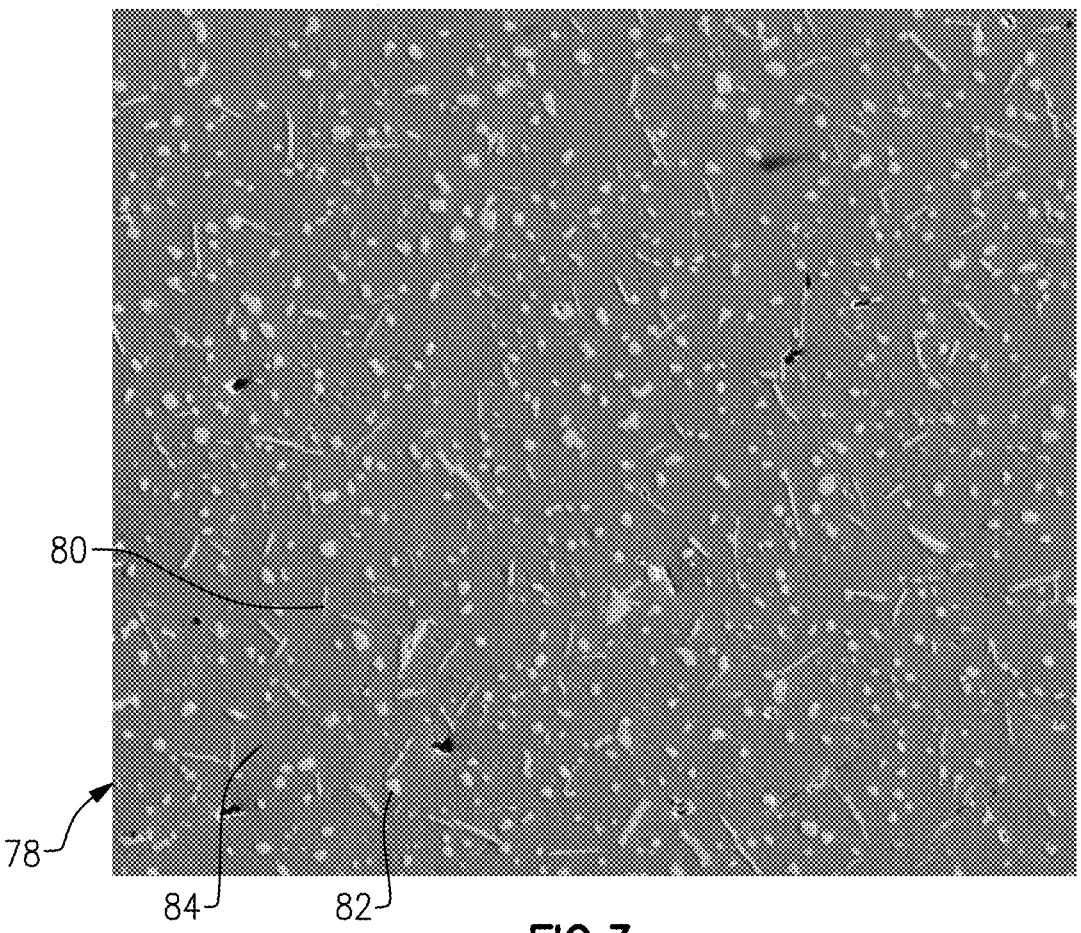
FIG. 3 illustrates an example microstructure.

After sintering, no boron nitride powder is observed in the resulting article 76. While not wishing to be bound by any particular theory, it is thought that the boron nitride powder disassociates during the sintering step and reacts with the elements of the starting alloy. FIG. 3 shows a representative microstructure 78 of the article 76. The microstructure 78 includes an acicular phase 80 and a non-acicular phase 82 that are disposed in a metal matrix 84, as well as porosity (black areas).

The acicular phase 80 is Nb-rich. For example, the acicular phase 80 includes, by weight, at least 25% Nb. In a specimen that was tested that was based on a 95:5 mixture, as determined by microprobe analysis, the acicular phase 80 included, by weight, an average of about 5% Ni, about 16.3% Cr, about 22.5% Mo, about 48.1% Nb, and about 8% of B. Nitrogen was also detected but was not quantified. Similar results were observed for a mixture of 90:10.

The non-acicular phase 82 is Mo-rich. For example, the non-acicular phase 82 includes, by weight, at least 50% Mo. In a specimen that was tested that was based on a 95:5 mixture, as determined by microprobe analysis, the non-acicular phase 82 included, by weight, an average of about 7% Ni, about 21.6% Cr, about 57.1% Mo, about 5.2% Nb, and about 9% B. Again, nitrogen was also detected but was not quantified. Similar results were observed for a mixture of 90:10. In general, the microstructure 78 of the article 76 has, by volume, 6% to 10% of the non-acicular phase 82 and 0.5-4% of the acicular phase 80.

The disclosed alloy also exhibits increased hardness in comparison to the base alloy without the boron and nitrogen. For example, the base alloy has a Vickers hardness of approximately 189, while the alloy made with the 95:5 ratio had a Vickers hardness of 248. An alloy made with the 90:10 ratio had a Vickers hardness of 212. In an article that is subject to wear, the increased hardness will facilitate improvement in wear resistance. The lower hardness of the 90:10 in comparison to the 95:5 is thought to be due to porosity. In general, the 95:5 exhibited good sintering with minimal cracking. The 90:10 exhibited an increase in cracking in comparison to the 95:5.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. An alloy composition comprising, by weight:
20% to 23% of Cr;
8% to 10% of Mo;
3.15% to 4.15% of Nb+Ta;
0.25% to 1.5% of B;
0.6% to 1.75% of N; and
a balance of Ni.

2. The alloy composition as recited in claim 1, wherein the B is 0.5% to 1.2%.

3. The alloy composition as recited in claim 1, where the N is 0.7% to 1.6%.

4. The alloy composition as recited in claim 1, wherein the B is 0.5% to 1.2% and the N is 0.7% to 1.6%.

5. The alloy composition as recited in claim 1, wherein the B is 0.4% to 0.7%.

6. The alloy composition as recited in claim 1, wherein the N is 0.6% to 0.9%.

7. The alloy composition as recited in claim 1, wherein the B is 1.1% to 1.3%.

8. The alloy composition as recited in claim 1, wherein the N is 1.4% to 1.7%.

9. An article comprising:
an alloy of the following composition, by weight:
20% to 23% of Cr;
8% to 10% of Mo;
3.15% to 4.15% of Nb+Ta;
0.25% to 1.5% of B;
0.35% to 1.75% of N; and
a balance of Ni,
wherein the alloy has a microstructure that includes an acicular phase and a non-acicular phase.

10. The article as recited in claim 9, wherein the acicular phase is Nb-rich.

11. The article as recited in claim 10, wherein the acicular phase includes, by weight, at least 25% Nb.

12. The article as recited in claim 9, wherein the non-acicular phase is Mo-rich.

13. The article as recited in claim 12, wherein the non-acicular phase incudes, by weight, at least 50% Mo.

14. The article as recited in claim 9, wherein the acicular phase is Nb-rich and includes, by weight, at least 25% Nb, the non-acicular phase is Mo-rich and incudes, by weight, at least 50% Mo, and microstructure has, by volume, 6% to 10% of the non-acicular phase and 0.5-4% of the acicular phase.

15. The article as recited in claim 9, wherein the B is 0.5% to 1.2%.

16. The article as recited in claim 9, where the N is 0.7% to 1.6%.

* * * * *